US008770318B2

(12) United States Patent
Shwets et al.

(10) Patent No.: US 8,770,318 B2
(45) Date of Patent: Jul. 8, 2014

(54) DRILLING MOTOR WITH A LOCKING COLLET SLEEVE STABILIZER

(75) Inventors: Peter Shwets, Dubai (UA); Nazeeh Melhem, Sugarland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 451 days.

(21) Appl. No.: 13/076,017

(22) Filed: Mar. 30, 2011

(65) Prior Publication Data

US 2011/0240370 A1 Oct. 6, 2011

Related U.S. Application Data

(60) Provisional application No. 61/319,906, filed on Apr. 1, 2010.

(51) Int. Cl.
*E21B 4/00* (2006.01)

(52) U.S. Cl.
USPC ..... 175/92; 175/325.2; 285/333

(58) Field of Classification Search
USPC ..... 175/92
See application file for complete search history.

(56) References Cited

U.S. PATENT DOCUMENTS

| | | | | |
|---|---|---|---|---|
| 1,892,217 | A | 12/1932 | Moineau | |
| 2,084,421 | A | 6/1937 | Wright | |
| 2,348,047 | A | 5/1944 | Yost | |
| 2,655,344 | A | 10/1953 | McDonald | |
| 2,813,697 | A | 11/1957 | Swart | |
| 3,987,849 | A | 10/1976 | Mott | |
| 4,225,000 | A | 9/1980 | Maurer | |
| 4,265,470 | A * | 5/1981 | Danner | 285/39 |
| 4,384,626 | A * | 5/1983 | Derouin | 175/57 |
| 4,683,964 | A | 8/1987 | Wenzel | |
| 4,708,513 | A | 11/1987 | Roche et al. | |
| 4,729,675 | A | 3/1988 | Trzeciak et al. | |
| 5,050,692 | A | 9/1991 | Beimgraben | |
| 5,997,010 | A * | 12/1999 | Lloyd | 279/2.03 |
| 8,061,451 | B2 * | 11/2011 | Salzer et al. | 175/325.3 |
| 2007/0252387 | A1 * | 11/2007 | Beard et al. | 285/323 |

FOREIGN PATENT DOCUMENTS

WO WO 2009151608 A1 * 12/2009

OTHER PUBLICATIONS

The Free Dictionary, The American Heritage Dictionary of the English Language, 2000, Houghton Mifflin Compnay, 4th Ed. Updated in 2009.*

* cited by examiner

*Primary Examiner* — Jennifer H Gay
*Assistant Examiner* — Caroline Butcher
(74) *Attorney, Agent, or Firm* — JL Salazar Law Firm

(57) ABSTRACT

A threaded sleeve stabilizer spans an upper stator connection in a mud driven drilling motor used for borehole drilling. A number of collets are loaded in compression between the stator and the housing of the motor, and are held in compression by a threaded connection.

24 Claims, 3 Drawing Sheets

DRILLING MOTOR WITH A LOCKING COLLET SLEEVE STABILIZER

CROSS REFERENCE TO RELATED APPLICATIONS

This application claims priority from U.S. Provisional Patent Application Ser. No. 61/319,906 filed on Apr. 1, 2010 which is incorporated by reference herein for all it discloses.

BACKGROUND OF THE INVENTION

1. Field of the Invention

The present invention relates generally to motors used in downhole drilling applications, and in particular, to downhole drilling motors that may be subjected to unusually high levels of bending stress, such as used in very deep and very extended lateral drilling operations. The downhole motor described herein has internal structures intended to improve its reliability and lengthen its intervals between servicing.

2. Description of the Related Art

Downhole drilling motors used in the oil and gas drilling industry typically include a drive shaft assembly connected between a power section and a bearing section. The drive shaft transfers torque from the eccentrically rotating power section to the concentrically rotating bearing assembly to rotate a drill bit as it is pushed against the earthen formation, effecting a drilling action.

The motor is often configured such that the axis of the power section is angularly offset from the axis of the bearing section and drill bit. The driveshaft assembly may include universal joints, or alternately 'flex' joints, on either end to accommodate the mis-alignment of the axes during a drilling operation while allowing transfer of torque from the power section of the motor through the bearing assembly and out to the drill bit.

During operation, drilling motors are often subjected to extreme, cyclic bending loads, and also rapidly varying compressive loads. In these applications, it may be difficult to maintain the internal components of drilling motors in their proper orientations. Shifting of these components during operation may result in sudden, premature and catastrophic failure of the motor.

A stabilizer is a drill string component well known in the art that typically has a plurality of blades, or raised portions of material, that extend radially outward from a main tubular body. The blades may extend to a diameter that is slightly less than the diameter of the wellbore. This configuration may permit the stabilizer to travel through the wellbore, while ensuring that the axis of the stabilizer is kept nearly concentric to the axis of the wellbore. The deflection of the drill string at the stabilizer location may, therefore, be limited to that permitted by a gap between the stabilizer blades and the wellbore. Because the outer surfaces of the blades may continually contact the wellbore due to side loading, these surfaces may be coated with abrasion-resistant material to reduce wear. The areas between the blades may form open channels that provide pathways to allow annular flow to pass by the stabilizer.

One type of stabilizer is a drill string component having top and bottom connections that connect to upper and lower components within the drill string. Another type of stabilizer is in the form of a threaded sleeve that threads to the outer diameter (OD) of one of the drill string components; for example, the lower stabilizer of a mud motor which is typically threaded to the OD a bearing assembly housing. The threaded sleeve option may allow interchangeability between stabilizers of different diameters, depending on the hole size and the amount of clearance desired.

Despite the advancement in drilling technology, there remains a need for advanced techniques for reinforcing drilling equipment. The present invention is directed at providing such advanced techniques.

BRIEF SUMMARY OF THE INVENTION

Figure 1:
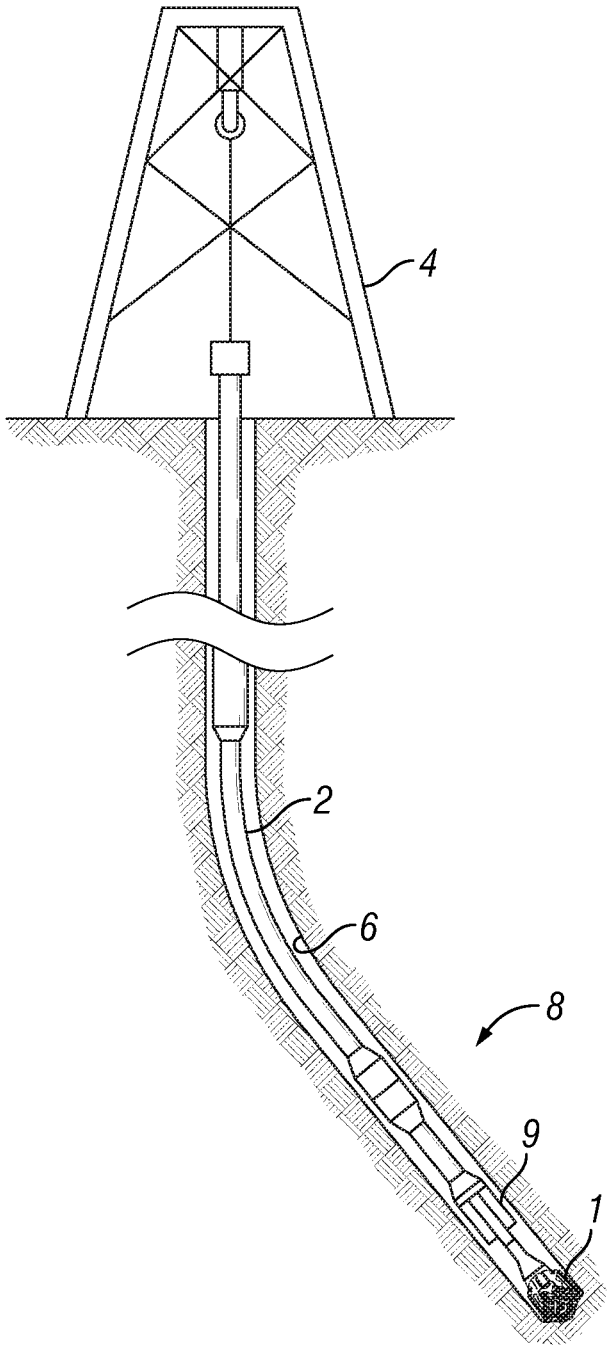
FIG. 1 is a schematic view of a very general and generic arrangement of a typical drilling rig for drilling boreholes into the earth.

In a typical bottom hole assembly (also known as a BHA) comprising a mud motor, the upper end of the power section stator is connected to a top sub (sometimes referred to as 'housing' or 'motor housing') which connects to the drill string components above. The connection between the top sub and stator may be susceptible to fatigue damage due to bending loads experienced during drilling operations. This connection can be exposed to excessive cyclic bending loads due to its location and the dynamics of the drill string during operation; however, the connection strength may be limited due to manufacturing and design limitations on the size and thickness of the stator tube. Disclosed herein is a new drilling motor that addresses this issue by providing an external means to strengthen and support the connection during drilling operations.

Further disclosed is an apparatus that may improve the bending strength of a threaded connection, and in particular the top connection of the stator in a mud powered borehole drilling motor assembly, which may be susceptible to fatigue damage due to bending loads experienced during the drilling operations.

The invention further encompasses a threaded sleeve stabilizer having a threaded sleeve that connects to the outside diameter (OD) of a "top sub" used with the above described motor. The stabilizer's threaded sleeve may be located axially over the threaded connection between the top sub and stator. The lower end of the stabilizer's threaded sleeve may have an internal bore that is located along the stator, outside of the stator tube below the stator box. An annulus may be created between the internal bore of the stabilizer's threaded sleeve and the OD of the stator which provides a chamber to receive a plurality of wedge like devices, hereinafter called 'collets'. Either the outer surface of the collets, or an inner surface within the stabilizer bore of the threaded sleeve, or both, may be tapered such that axial force on the bottom of the collets will cause the collets to be wedged between the outside of the stator of the motor and the inside of the stabilizer's threaded sleeve.

The collets described herein may have an internal wedge configuration to secure the internal components. The wedge collets may be made of a material having a lower modulus of elasticity than the motor housing. Alternately, the collets may have the same modulus of elasticity, but have a significantly lower hardness than the motor housing. Alternately, the collets may be sized and shaped such that they will operate effectively regardless of their composition or material properties. The wedge shape may be used to help assure that the internal components remain in proper position during operation, and thus help to maintain their relative position within the motor during operation.

The lower end of the stabilizer's threaded sleeve may have a threaded box located below the collets into which is threaded a locking sleeve which, when makeup torque has been applied, contacts the collets and provides axial force to wedge them upward between the threaded sleeve and the stator. The wedged collets firmly secure the lower end of the threaded sleeve of the stabilizer to the stator while the upper end of the threaded sleeve of the stabilizer is secured to the top sub through the threaded connection therebetween. This arrangement effectively adds stiffness to the threaded connection between the top sub and stator. In addition, the OD of the threaded sleeve of the stabilizer may be closely sized to the borehole diameter, limiting deflection of the BHA at that location and providing further stability to the stator and top sub connection during drilling operations.

In one aspect, therefore, a wedge arrangement formed from a plurality of collets may be disposed intermediate the stator and the motor housing. In this configuration the wedge arrangement may include one or more collets. Each collet may be distinct from each other so as to be individually fitted into the motor so as to be independent of each other. They may have generally the same width, or alternately, the collets may be of varying widths to accommodate assembly.

Further disclosed is a downhole motor adapted for drilling boreholes into the earth having a compression loaded retention device. A number of separate collets may be loaded in compression between the stator and the housing of the motor, and are held in compression by a threaded connection. The collets may be used for the maintaining the compressive loading of the components at a thrust bearing end of a driveshaft assembly for a downhole motor.

DETAILED DESCRIPTION OF THE INVENTION

FIG. 1 shows a very schematic representation of a drill string 2 suspended by a derrick 4 for drilling a borehole 6 into the earth for minerals exploration and recovery, and in particular petroleum. A bottom-hole assembly (BHA) 8 is located at the bottom of the borehole 6. Oftentimes, the BHA 8 may have a downhole drilling motor 9 to rotate a drill bit 1.

As the drill bit 1 is rotated by the downhole motor 9, it drills into the earth allowing the drill string 2 to advance, forming the borehole 6. For the purpose of understanding how these systems may be operated for the type of drilling system as illustrated in FIG. 1, the drill bit 1 may be any one of numerous types well known to those skilled in the oil and gas exploration business. This is just one of many types and configurations of bottom hole assemblies 8, however, and is shown only for illustration. There are numerous arrangements and equipment configurations possible for use for drilling boreholes into the earth, and the present disclosure is not limited to the particular configurations as described herein.

Figure 2:
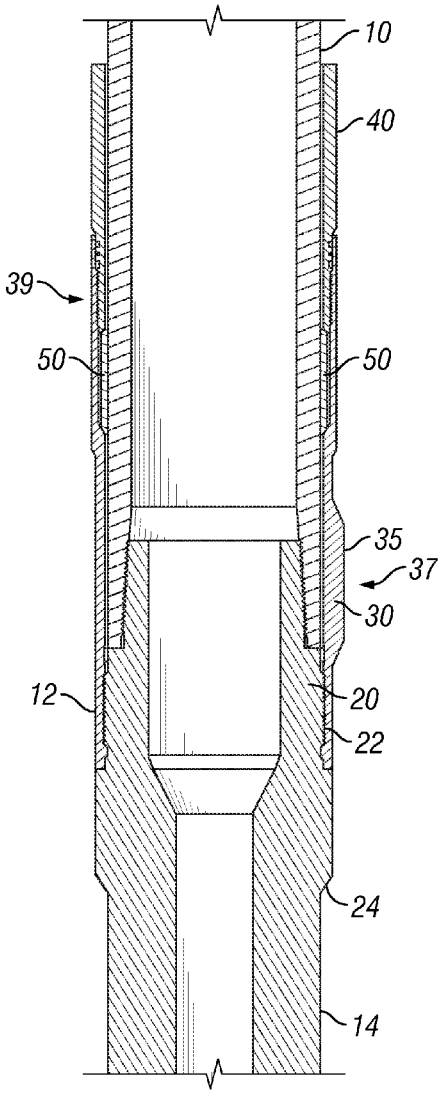
FIG. 2 is a partial cross-section view of a threaded connection portion of a downhole motor of the present invention, illustrating the general arrangements of the individual components making up the connection.

As shown in FIG. 2, the invention disclosed herein may employ a locking (or threaded) sleeve stabilizer 37 that spans an upper stator connection 39 and is secured to a top sub 14 and a stator 10, for providing additional stiffness to the connection while limiting drill string deflection at this location.

Figure 3:
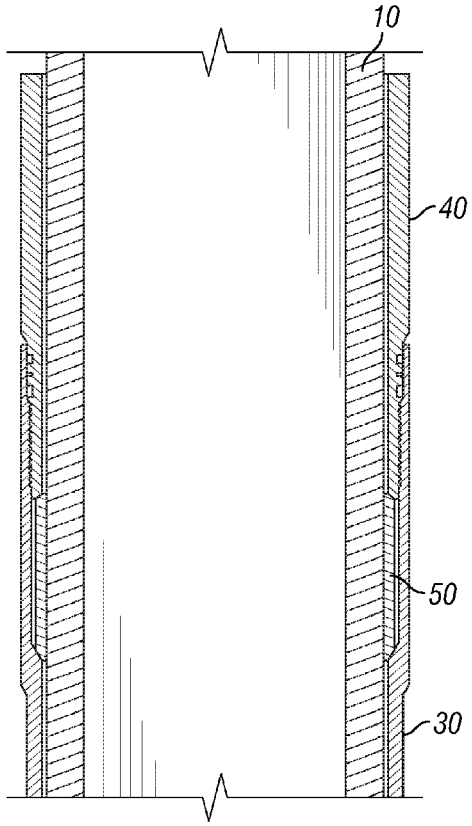
FIG. 3 is magnified partial section view showing in greater detail the arrangement of selected components of the threaded connection portion of a downhole motor of the present invention as shown in FIG. 2, and in particular one arrangement of locking collet members of the present invention.

The downhole drilling motor 9 of FIG. 1 may comprise the stator 10, as shown in FIGS. 2 and 3. Typically, there is a long tubular body component of the mud motor 9 power section 12, as shown in FIG. 2. During drilling operations, certain conditions can lead to excessive cyclic bending loads at the upper and lower threaded connections, which can ultimately lead to fatigue failure.

The component of the motor 9 that the top or bottom of the stator 10 is connected to is known as the motor housing 20 (e.g., top sub 14, lock housing).

The motor housing 20 is fitted with external threads 22 and an upset 24 for a stabilizer sleeve 30 of the locking sleeve stabilizer 37 to thread onto and shoulder against.

An additional component of the drilling motor 9 of the present invention is the stabilizer sleeve 30. The stabilizer sleeve 30 is a threaded sleeve with a plurality of blades 35 that protrude radially outward. Like any drill string stabilizer, as is well known in the art, the blades 35 extend to a diameter that is slightly less than the diameter of the wellbore, which permits the threaded sleeve stabilizer 37 to travel through the wellbore 6 while ensuring that the axis of the threaded sleeve stabilizer 37 is kept nearly concentric to the axis of the wellbore 6. The blades 35 may be aligned axially with the end connection of the stator 10, limiting the deflection of the end of the stator 10 to that permitted by a gap between the stabilizer blades 35 and the wellbore 6. Because the outer surfaces of the blades 35 may continually contact the wellbore 6 due to side loading, these surfaces may be coated with abrasion-resistant material to reduce wear. The areas (not shown) between the blades 35 form open channels that provide pathways for annular flow to pass by the threaded sleeve stabilizer 37.

Figure 4:
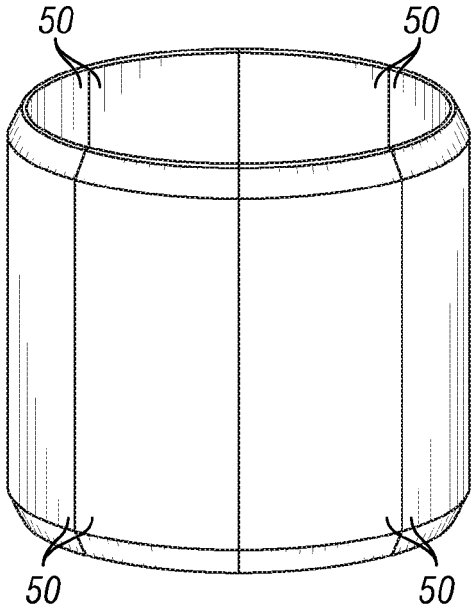
FIGS. 4 and 5 are views of the arrangement of the locking collets members used to both preload and stiffen the threaded connection portion of a downhole motor of the present invention as shown in FIGS. 2 and 3.
Figure 5:
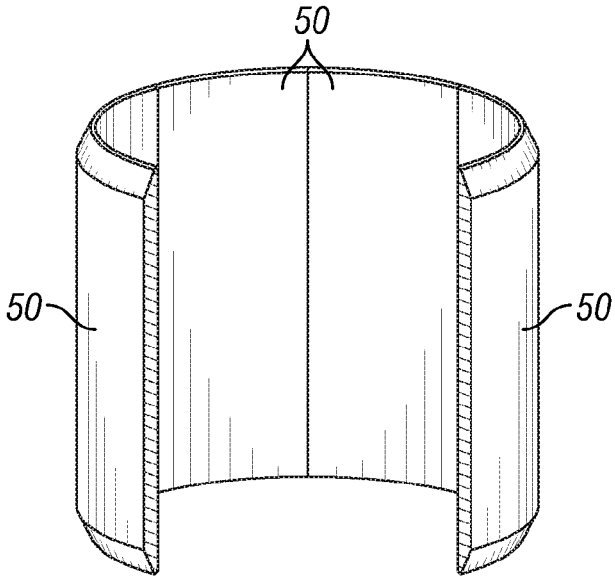

The stabilizer sleeve 30 is threaded at both ends. The first end is rigidly secured to the external threads 22 along the body of the motor housing 20. The second end is located along the OD of the stator 10. The internal bore of the stabilizer sleeve 30 provides an annular region along the outside of the stator 10, into which is inserted a plurality of collets 50, as shown in more detail in FIGS. 4 and 5. A locking sleeve 40 wedges the collets 50 between the stabilizer sleeve 30 and the stator 10. In these Figures, the collets 50 are illustrated as fitting together as a smooth cylinder that forms a generally cylindrical ring. However, it is contemplated that these collets 50 may have any one of a variety of shapes, and do not necessary present a smooth outside or inside wall to their mating surfaces. Furthermore, the individual collets do not generally need to have smooth outside surfaces, and may be grooved or roughened on the inside or outside to facilitate fitting. Finally, although the collets 50 as illustrated all have approximately the same width, they may be formed so as also being varied in width.

Also, it is also possible that one or some of the collets 50 may be formed from a material different from the other collets 50, and that material may have a hardness or modulus of elasticity differing from the other collets 50, or from the material of the stator 10 or locking sleeve 40.

Preferably, however, the collets 50 as illustrated are made of steel and machined to shape. Alternately, it may be desirable to form the collets 50 in a casting, forging or one of many other well known forming processes.

Referring to FIGS. 2 and 3, the ends of the stabilizer sleeve 30 may be firmly secured along either side of the stator 10 end connection by the collets 50. The stiffness of the stabilizer sleeve 30 thus may be used to add rigidity to the end connection of the stator 10, for lowering the cyclic bending stresses induced at this location during drilling operations and providing protection against fatigue failure.

This new motor design, which incorporates the threaded sleeve stabilizer 37, may be used to improve the bending strength of the threaded connection. For example, the threaded sleeve stabilizer 37 may be used in the top connection of the stator 10 in the mud motor assembly 9, which may be susceptible to fatigue damage due to bending loads experienced during drilling operations.

Furthermore, the threaded sleeve stabilizer 37, as disclosed herein, may connect to the outside diameter of the top sub 14 in the bottom hole assembly 8. The threaded sleeve stabilizer 30 may be located axially over the threaded connection between the top sub 14 and stator 10. The lower end of the stabilizer 30 may have an internal bore that is located along the outside of the stator 10 tube below the stator 10 box as shown in FIG. 2.

An annulus may be created between the internal bore of the stabilizer 30 and the OD of the stator 10 which provides a chamber to receive the plurality of collets 50.

As shown in FIG. 3, either the outer surface of the collets 50, or an inner surface within the stabilizer 30 bore, or both, may be tapered such that axial force on the bottom of the collets 50 will cause the collets 50 to be wedged between the outside of the stator 10 and the inside of the stabilizer 30. The lower end of the stabilizer 30 has a threaded box located below the collets 50 into which is threaded the locking sleeve 40 which, when makeup torque has been applied, contacts the collets 50 and provides axial force to wedge them upward between the stabilizer 30 and the stator 10. The wedged collets 50 firmly secure the lower end of the stabilizer 30 to the stator 10 while the upper end of the stabilizer 30 is firmly secured to the top sub 14 through the threaded connection therebetween, which effectively adds stiffness to the threaded connection between the top sub 14 (as shown in FIG. 2) and stator 10. In addition, the OD of the stabilizer 30 is closely sized to the hole diameter of the wellbore, limiting deflection of the BHA at that location and providing further stability to the stator 10 and top sub 14 connection during drilling operations.

Whereas the present invention has been described in particular relation to the drawings attached hereto, it should be understood that other and further modifications apart from those shown or suggested herein, may be made within the scope and spirit of the present invention. While the present disclosure describes specific aspects of the invention, numerous modifications and variations will become apparent to those skilled in the art after studying the disclosure, including use of equivalent functional and/or structural substitutes for elements described herein. For example, while certain embodiments have been described, modifications thereof can be made by one skilled in the art without departing from the scope or teachings herein. For example, the collets may be of various shapes and materials to provide the desired results.

Plural instances may be provided for components, operations or structures described herein as a single instance. In general, structures and functionality presented as separate components in the exemplary configurations may be implemented as a combined structure or component.

Similarly, structures and functionality presented as a single component may be implemented as separate components. These and other variations, modifications, additions, and improvements may fall within the scope of the inventive subject matter.

What is claimed:

1. A locking sleeve stabilizer for a connection between a stator of a downhole drilling motor and a housing of an adjacent sub, the locking sleeve stabilizer comprising:

a threaded sleeve comprising a locking sleeve and a stabilizer sleeve, the locking sleeve positionable about the stator, the stabilizer sleeve threadedly connected to the housing, the stabilizer sleeve threadedly connectable to the locking sleeve; and a plurality of collets arrangeable in a generally cylindrical ring and loadable into compression by the threaded sleeve to lock the stator of the drilling motor to the housing, providing stiffness of the connection between the stator and the housing.

2. The locking sleeve stabilizer of claim 1 wherein the plurality of collets are formed from a different material than the material of the threaded sleeve.

3. The locking sleeve stabilizer of claim 1 wherein a bending strength of a threaded connection at an end of the stator is greater than a bending strength of the housing thereby providing additional stiffness to the threaded connection while limiting drill string deflection by effectively adding stiffness to the threaded connection between the housing and the stator.

4. The locking sleeve stabilizer of claim 1 wherein the threaded sleeve connects to an outside diameter of the housing.

5. The locking sleeve stabilizer of claim 4 wherein the threaded sleeve is located axially over the threaded connection between the housing and a stator.

6. The locking sleeve stabilizer of claim 1 wherein an end of the threaded sleeve has an internal bore that is located along an outside of a stator tube and below a stator box of the stator.

7. The locking sleeve stabilizer of claim 6 wherein an annulus is created between an internal bore of the threaded sleeve and an outer diameter of the stator which provides a chamber to receive the plurality of collets.

8. The locking sleeve stabilizer of claim 7 wherein either the outer surface of the plurality of collets, or an inner surface within the internal bore of the threaded sleeve, or both, are tapered such that an axial force on a bottom of the plurality of collets cause the plurality of collets to be wedged between the outside of the stator and an inside of the threaded sleeve.

9. The locking sleeve stabilizer of claim 1 wherein the plurality of collets have an internal wedge configuration to secure internal components.

10. The locking sleeve stabilizer of claim 9 wherein the internal wedge configuration allows the plurality of collets to remain in proper position during operation to maintain a relative position within the motor during operation.

11. The locking sleeve stabilizer of claim 1 wherein the plurality of collets are made of a material having a lower modulus of elasticity than the housing.

12. The locking sleeve stabilizer of claim 1 wherein the plurality of collets have the same modulus of elasticity of the housing, but have a lower hardness than the housing.

13. The locking sleeve stabilizer of claim 1 wherein an end of the threaded sleeve has a threaded box located below the plurality of collets into which is threaded the locking sleeve which, when makeup torque has been applied, contacts the plurality of collets and provides axial force to wedge the plurality of collets upward between the threaded sleeve and the stator.

14. The locking sleeve stabilizer of claim 13 wherein the wedged plurality of collets firmly secure an end of the threaded sleeve to the stator while another end of the threaded sleeve is secured to the housing through the threaded connection therebetween to effectively add stiffness to the connection between the housing and stator.

15. The locking sleeve stabilizer of claim 1 wherein an outer diameter of the threaded sleeve is sized to a diameter of the borehole and thereby limiting deflection of a bottom hole assembly and providing additional stability to the connection between the housing and stator during drilling operations.

16. The locking sleeve stabilizer of claim 1 wherein a wedge arrangement formed from the plurality of collets is disposed intermediate the stator and the housing.

17. The locking sleeve stabilizer of claim 16 wherein the wedge arrangement includes one or more of the plurality of collets.

18. The locking sleeve stabilizer of claim 1 wherein each of the plurality of collets is distinct from each other so as to be individually fitted into the motor so as to be independent of each other.

19. The locking sleeve stabilizer of claim 1 wherein the plurality of collets have generally the same width.

20. The locking sleeve stabilizer of claim 1 wherein the plurality of collets are of varying widths to accommodate assembly.

21. The locking sleeve stabilizer of claim 1 wherein threads of the threaded sleeve threadedly connect to threads of the housing.

22. The locking sleeve stabilizer of claim 1, wherein the stabilizer sleeve has blades thereon.

23. A downhole motor adapted for drilling boreholes into the earth comprising:

a stator; and a compression loaded retention device operatively connectable to the stator and an adjacent sub to support a connection therebetween, the retention device comprising:

a threaded connection comprising a locking sleeve and a stabilizer sleeve, the locking sleeve positionable about the stator of the drilling motor, the stabilizer sleeve threadedly connected to a housing of the adjacent sub, the stabilizer sleeve threadedly connectable to the locking sleeve; and a plurality of separate collets that are loaded in compression between the stator and the housing of the adjacent sub, and are held in compression by the threaded connection wherein the plurality of separate collets maintain the compressive loading thereof at an end of the motor.

24. The downhole motor of claim 23, wherein threads of the stabilizer sleeve threadedly connect to threads of the housing.

* * * * *